US007604580B2

(12) United States Patent
Lamarque

(10) Patent No.: US 7,604,580 B2
(45) Date of Patent: Oct. 20, 2009

(54) EXERCISE DEVICE AND METHOD

(76) Inventor: Matthew Justin Lamarque, 703 Ocean Ave., Monterey, CA (US) 93940

( * ) Notice: Subject to any disclaimer, the term of this patent is extended or adjusted under 35 U.S.C. 154(b) by 0 days.

(21) Appl. No.: 11/440,223

(22) Filed: May 24, 2006

(65) Prior Publication Data

US 2007/0087923 A1 Apr. 19, 2007

Related U.S. Application Data

(60) Provisional application No. 60/684,334, filed on May 25, 2005.

(51) Int. Cl.
*A63B 26/00* (2006.01)

(52) U.S. Cl. ..... 482/140; 482/139; 446/313; 273/359

(58) Field of Classification Search ..... 482/140, 482/142, 23, 25, 148; D21/662, 676, 686, D21/690; 273/359; 446/313
See application file for complete search history.

(56) References Cited

U.S. PATENT DOCUMENTS 941,665 A * 11/1909 Thornley ..... 482/25
1,013,685 A * 1/1912 Beach ..... 482/25
4,927,139 A * 5/1990 Taltre ..... 482/142
4,953,857 A * 9/1990 Lemire ..... 482/142
5,584,786 A * 12/1996 Almeda ..... 482/142
5,755,647 A * 5/1998 Watnik ..... 482/121
6,048,293 A * 4/2000 Lee ..... 482/140
RE38,057 E * 4/2003 Pandozy ..... 482/97
6,666,802 B1 * 12/2003 Rasmussen ..... 482/148
6,939,272 B1 * 9/2005 Wu ..... 482/92
7,153,249 B2 * 12/2006 O'Connor ..... 482/142
7,390,289 B2 * 6/2008 Wu ..... 482/142
2006/0116262 A1 * 6/2006 Pandozy ..... 482/142

* cited by examiner

*Primary Examiner*—Lori Baker
(74) *Attorney, Agent, or Firm*—Patrick Reilly

(57) ABSTRACT

A method and device for use in resistance training is provided. A first version includes a saddle that supports the lower back while an exercise subject extends and then hyper-extends the subject's vertebral column. A second version includes a foot bar against which the subject applies force from the foot or lower leg while extending, hyperextending the subject's vertebral column. A third version includes a knee bar against which the subject pulls while extending, hyperextending and contracting the subject's vertebral column.

18 Claims, 9 Drawing Sheets

12
22
22
22

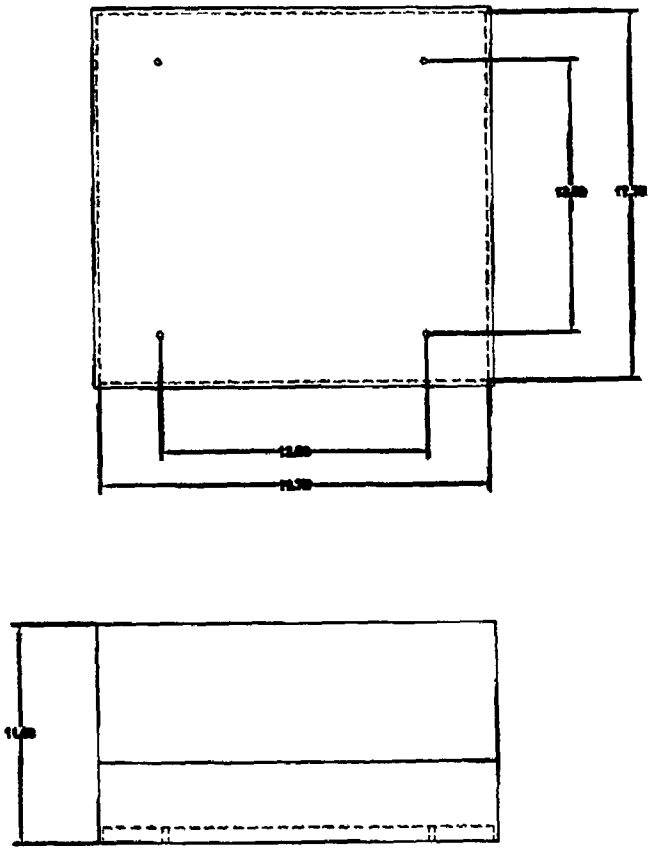
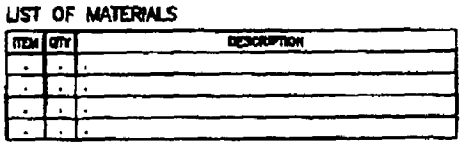
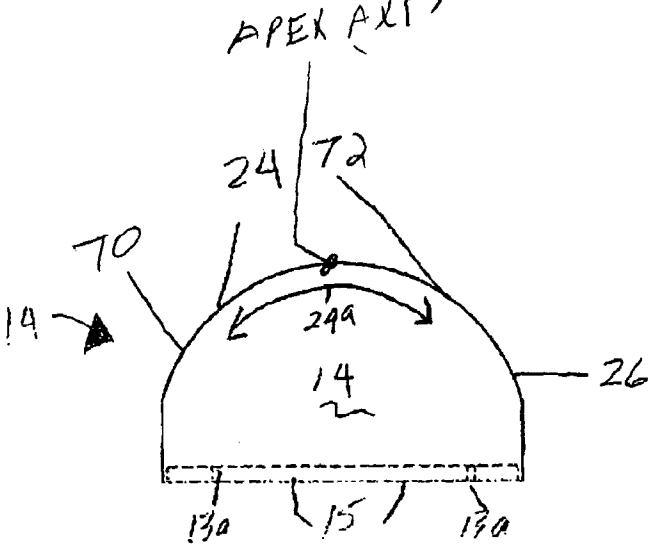
FIG. 5

LIST OF MATERIALS

| ITEM | QTY | DESCRIPTION |
|---|---|---|
| 1 | 8" | 2" O.D. x .083 WALL STEEL SQUARE TUBING |
| 2 | 23" | 1.75" O.D. x .083 WALL STEEL SQUARE TUBING |
| 3 | 2 | MOTOR BUMPARTS, P/N: PM8E 1/2" POP PIN |
| | | |

EXERCISE DEVICE AND METHOD

CO-PENDING PATENT APPLICATION

This application for patent is a continuation-in-part to U.S. Provisional Patent Application Ser. No. 60/684,334, entitled "Exercise Machine and Method" filed on May 25, 2005. That U.S. Provisional Patent Application Ser. No. 60/684,334 is incorporated in its entirety and for all purposes. The benefit of the May 25, 2005 priority date of the U.S. Provisional Patent Application Ser. No. 60/684,334 is claimed for this application for patent.

FIELD OF THE INVENTION

The Present Invention relates to exercise devices and techniques applied by human subjects for to increase physical fitness. More particularly, the Present Invention relates to the use of body weight and additional weights in resistance exercise training.

BACKGROUND OF THE INVENTION

Devices and techniques used to improve physical fitness often attempt to isolate specific muscles or muscle groups wherein the isolated muscle or muscles are repeatedly moved in a specified range of motion. Resistance training protocols in particular typically direct a subject to use their own body weight as a source of resistance against a prescribed movement, e.g., a push up or a pull up. External weights may also be used by a subject to increase the resistance load that the subject works against in executing the prescribed motion.

Humans have long recognized the beneficial interrelationships between exercise, muscle fitness, and health. Various exercise techniques and devices have been provided to promote healthy muscle tissue and development, to assist in metabolic regulation, and to improve the general function and overall appearance of the body. However, some muscles and muscle groups of the human body are easier to exercise in isolation than other muscles. The bicep muscles of the human arm, for example, are generally easier to engage in resistance training than the abdominal muscles. In particular, designing a resistance training exercise with the intent to strengthen the human abdominal muscles requires that attention be paid to the risk of injury to the human verterbrae.

The categories of exercise used to improve muscle fitness include, for example, isometric, isotonic, and isokynetic. Isometric exercise may strengthen muscles through contraction of the muscles. Isotonic exercise may strengthen through the contraction and relaxation of muscles, as the instant muscles flex and extend. The incorporation of weight (such as free weights or body weight) into such exercises may increase the benefits of exercise by the addition of resistance training dynamics. An example of weight-bearing exercise, i.e., resistance training, can be seen in a simple pushup, during which various groups of muscles in the arm contract and release during each pushup while bearing at least a portion of the body's weight.

Isokynetic exercise may strengthen muscles through the use of various systems such as weight machines, whereby various pulleys and weight stacks add exertion, resistance, and weight to pulling, pushing, or lifting exercises.

Such techniques and equipment are often directed to specific areas of the human body in an effort to target specific muscles groups. One oft-targeted area, for example. includes the muscles located in the abdominal region of the body, generally between the thorax and the pelvis. For example, the rectus abdominus is a long, flat muscle that extends vertically the entire length of the abdomen and is enclosed in a sheath that holds the rectus abdominus in position but does not restrict movements during its contractions.

The abdominal muscles (hereinafter. abs) flex the vertebral column, i.e., the spine, particularly in the lumbar portion, and may draw the sternum, or breastbone, toward the pubis. Certain abs may also tense the abdominal wall and aid in compressing the contents of the abdomen and enhance prevention of strain or injury to the lower lumbar region of the spine. Hence, strong, well-developed "abs" may be directly linked to the efficient mobility and functionality of the body as well as provide a widely coveted appearance of "flat abs".

A number of difficulties exist, however, with respect to increasing, developing and maintaining the muscular tone and condition of abs. One issue surrounds the relative location of the abs with respect to exercise equipment. The torso region of the body is not easily given to manipulation of exercise equipment as are, for example, the arms. Various muscles groups of the chest, arms and back may be targeted by simply grasping and manipulating free weights or weighted/stretching components of various machines or by simply performing push-ups or pull-ups.

The relative involvement of antagonistic groups of muscles during movement of the torso, and the tendency for one group to dominate another creates an additional challenge for exercise equipment and techniques intended to strengthen the abs. Such involvement may be antagonistic wherein one group of muscles tends to oppose another in motion. For example, when certain groups of muscles are fully engaged it may be difficult or impossible to fully engage a muscle or muscle group antagonistic to the engaged group.

This difficulty may be illustrated by way of considering the hamstring and gluteus maximus (gluts) versus the hip flexors. When the hamstring and gluts contract or engage, the hip flexors generally extend and lengthen, and the opposing functions serve to straighten out the vertebral column into an erect posture. When the hip flexors engage or contract, the hamstrings and gluts generally tend to extend and lengthen. The opposing functions and activities of the hamstrings and gluts versus the hip flexors serve to bend the hips moving the upper body forward and away from an erect pose. In other words, when one muscle group is engaged, that very engagement may serve to inhibit engagement of the other antagonistic muscle or muscle group, and vice versa.

Additionally~certain groups of muscles dominate others; i.e. the dominant muscles tend to engage more quickly and to greater degree than submissive groups. For example. the iliopsoas muscle, or hip flexor, is a powerful flexor muscle of the thigh at the hip joint. If engaged, the hip flexor may act as important flexors of the trunk or the hip, as in sitting up from a supine position. As the hip flexors are both dominant and antagonistic with respect to the abdominal muscles, the hip flexors tend to engage before the abs, and thereby tend to inhibit some or all of the contraction of the abs. During a typical sit-up or "crunch" exercise directed to the abs, the hip flexors may actually engage and provide the underlying functionality to translate the body from a first position to a second position with little or no engagement of the abs, thus undermining the full ability of the abs to contract and resulting in minimal exercise efficiency of the abs.

Another issue affecting the design of resistance training exercises for the abs involves the range of motion of a muscle or a group of muscles. The most effective exercise typically includes exercise of a muscle across a full range of motion of the selected muscle. The full range of motion typically includes a first position of full extension of the muscle to a second position of full contraction of the muscle. Certain muscle groups, such as the abs, present some difficulty during exercise in achieving muscle movement across the full range of motion. For example, during a sit-up or "crunch" exercise, the exerciser typically adopts an initial supine position, wherein the spine forms a 180 degree angle relative to a surface on which the exerciser's torso lies. In this position, the abs are not fully extended and therefore only a truncated contraction of the abs can be achieved. To fully extend the abs, one must hyperextend the spine, arching it backwards. Such a hyperextension of the spine, however, exposes various areas of the body to injury. For example, a hyperextension of the spine exerts an excess load of body weight on the lumber region, or lower back, which may result in injury, pain. or strain. In addition, such a hyperextended position to fully extend the abs may be difficult to achieve. For example, one might perform a "backbend" position; i.e. feet planted and arms extended overhead, arching the back until the palms of the hands touch the ground. This position, however, is difficult—perhaps impossible—for a majority of persons to achieve. Further, contraction of the abs when in a back bend pulls the body upright off the ground, but in doing so again applies a great deal of weight upon the otherwise unsupported lumbar region, thereby exposing one to a significant risk of injury and pain.

The human spine is made up of thirty three irregularly shaped bones called vertebrae. Each vertebra has a hole in the middle through which the spinal cord runs. The spine can be divided into five different regions, to include: (a.) seven cervical vertebrae that support the human to head and neck and allow a human to nod and shake his or her head, (b.) twelve thoracic vertebrae that anchor the human ribs, (c.) five sturdy lumbar vertebrae that carry most of the weight of the human upper body and provide a stable centre of gravity during locomotion, (d.) five vertebrae fused to form the sacrum that partially constitute a back wall for some of the muscles, tissues and organs that are supported by the pelvis, and (e.) a coccyx is made up of four fused vertebrae. The coccyx is generally held to be an evolutionary remnant of the tail found in many other vertebrates.

The Method of the Present Invention addresses the needs of physical therapists, physical trainers and other health service providers to design and teach resistance training exercises that reduce the likelihood of damage to the spine when performed by their clients and patients.

OBJECTS OF THE INVENTION

It is an object of the Method of the Present Invention to provide a method that enables the application of resistance training principles in an exercise protocol.

It is an optional object of the Method of the Present Invention to provide a device that enables the application of resistance training principles in an exercise protocol.

SUMMARY OF THE INVENTION

These and other objects will be apparent in light of the prior art and this disclosure. Variations of the technology may provide mechanisms for performing select exercises. The exercises may include, for example, but are not limited to, abdominal exercises. The Method of the Present Invention may (1.) facilitate engagement and extension of selected muscles groups; (2.) facilitate full range of motion of selected muscle groups; (3.) facilitate correct posturing for a given exercise; and/or (4.) may minimize exposure to ceria in types of injuries and pain. The Method of the Present Invention may provide various combinations of components and subcomponents drawn to a variety of exercises.

The foregoing and other objects, features and advantages will be apparent from the following description of the preferred embodiment of the invention as illustrated in the accompanying drawings.

BRIEF DESCRIPTION OF THE DRAWINGS

These, and further features of the invention, may be better understood with reference to the accompanying specification and drawings depicting the preferred embodiment, in which: These, and further features of the invention, may be better understood with reference to the accompanying specification and drawings depicting the preferred embodiment, in which:

FIG. 5 is a side view of a saddle of the exercise machine of FIG. 1 designed according to the Method of the Present Invention;

DETAILED DESCRIPTION OF A PREFERRED EMBODIMENT

In describing the preferred embodiments, certain terminology will be utilized for the sake of clarity. Such terminology is intended to encompass the recited embodiment, as well as all technical equivalents, which operate in a similar manner for a similar purpose to achieve a similar result.

The Method of the Present Invention may be drawn to, for example, various exercise equipment. The exercise equipment may provide for maximum abdominal muscle recruitment. For example, the Method of the Present Invention may facilitate extension of the abdominal muscles in a supported fashion, thus providing improved, desirable or maximum opportunity for muscle involvement and activation. In another example, the Method of the Present Invention may provide, alone or in conjunction with the foregoing, various components to facilitate isolation or maximum focus on selected muscle groups, for example, the abdominal muscles. In still another example, the Method of the Present Invention may further provide steps for maximizing the effectiveness of abdominal exercises, for maximizing the focus on selected muscle groups such as the abdominal muscles, or both.

The Method of the Present Invention may accommodate body weight during various exercises or may provide for the additions of weighted components, either of which may increase the effectiveness of the equipment. The exercises, and/or provide other beneficial results. A skilled artisan will recognize that other benefits and features may be provided, and that examples herein are illustrative only and not limitative of scope.

Figure 1:
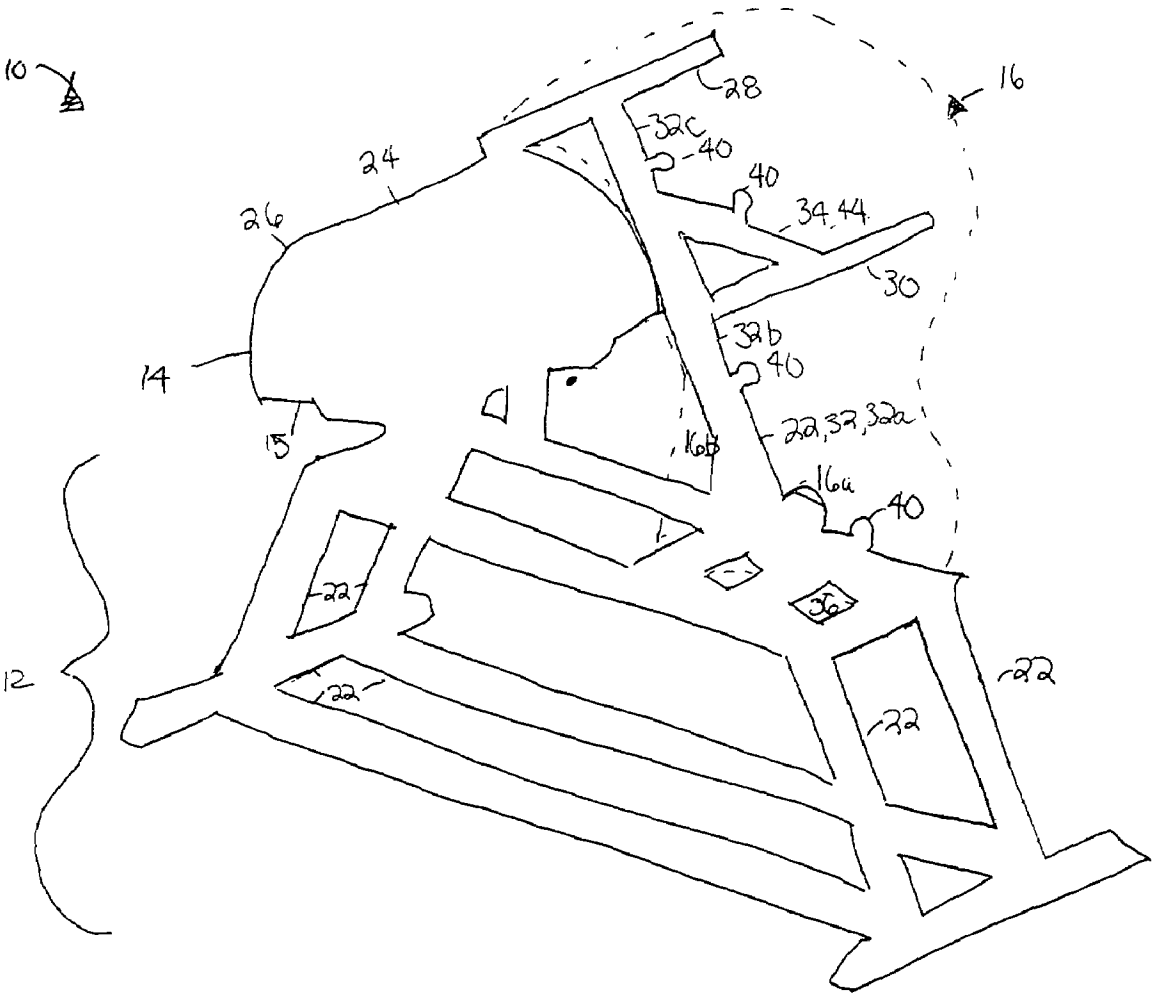
FIGS. 1, 2, and 3 are perspective views of an exercise machine designed and operated according to the Method of the Present Invention.
Figure 2:
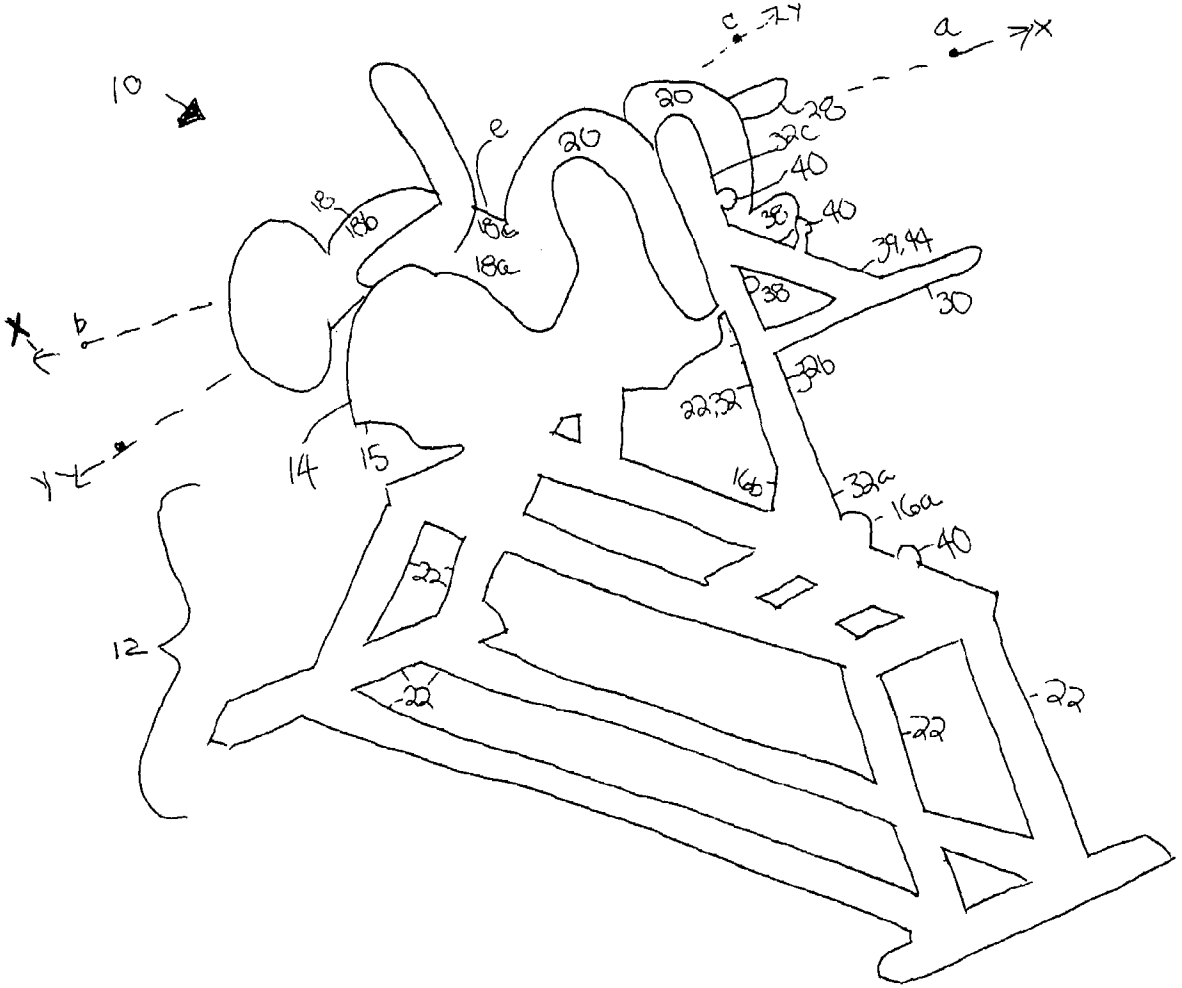
Figure 3:
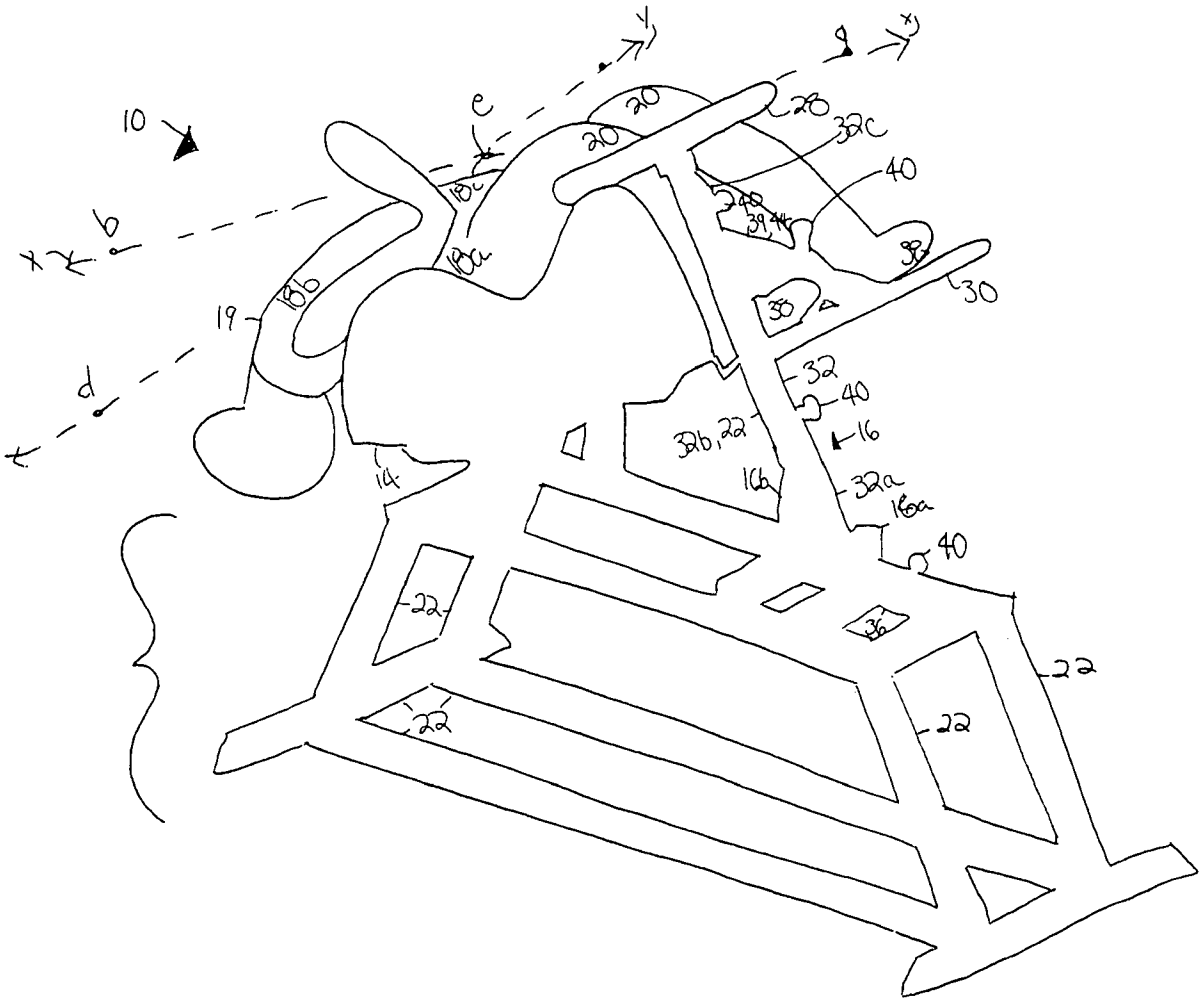

With reference now to the drawings, wherein like items are referenced with the same numeral, and in particular FIGS. 1, 2, and 3 there are shown generally at 10 an exercise machine. The exercise machine 10 may include, for example, a base shown generally at 12; a saddle 14; and a lower body support assembly 16. The base 12 may generally support the saddle 14 and the lower body support assembly 16. The saddle 14 may support, for example, the lumbar region and surrounding regions of a user 18, while the lower body support assembly 16 may support, for example, various lower body portions of the user 18, such as the legs 20 and/or the feet 38 (as shown in FIGS. 2 and 3, respectively).

Variations of the Method of the Present Invention may provide for integral designs, or alternatively, isolated components and subcomponents of the invention, as well as various combinations of the components and subcomponents. For example, the base 12 and the lower body support assembly 16 may be integrally formed from a single structure, may be constructed as individual components and mechanically joined or associated with one another, or may be individual "stand alone" components used alone or in combination, wherein, for example, a user is supported by the saddle 14 of the base 12 and extends legs 20 over the lower body support assembly 16 (as shown in FIG. 2).

Figure 4:
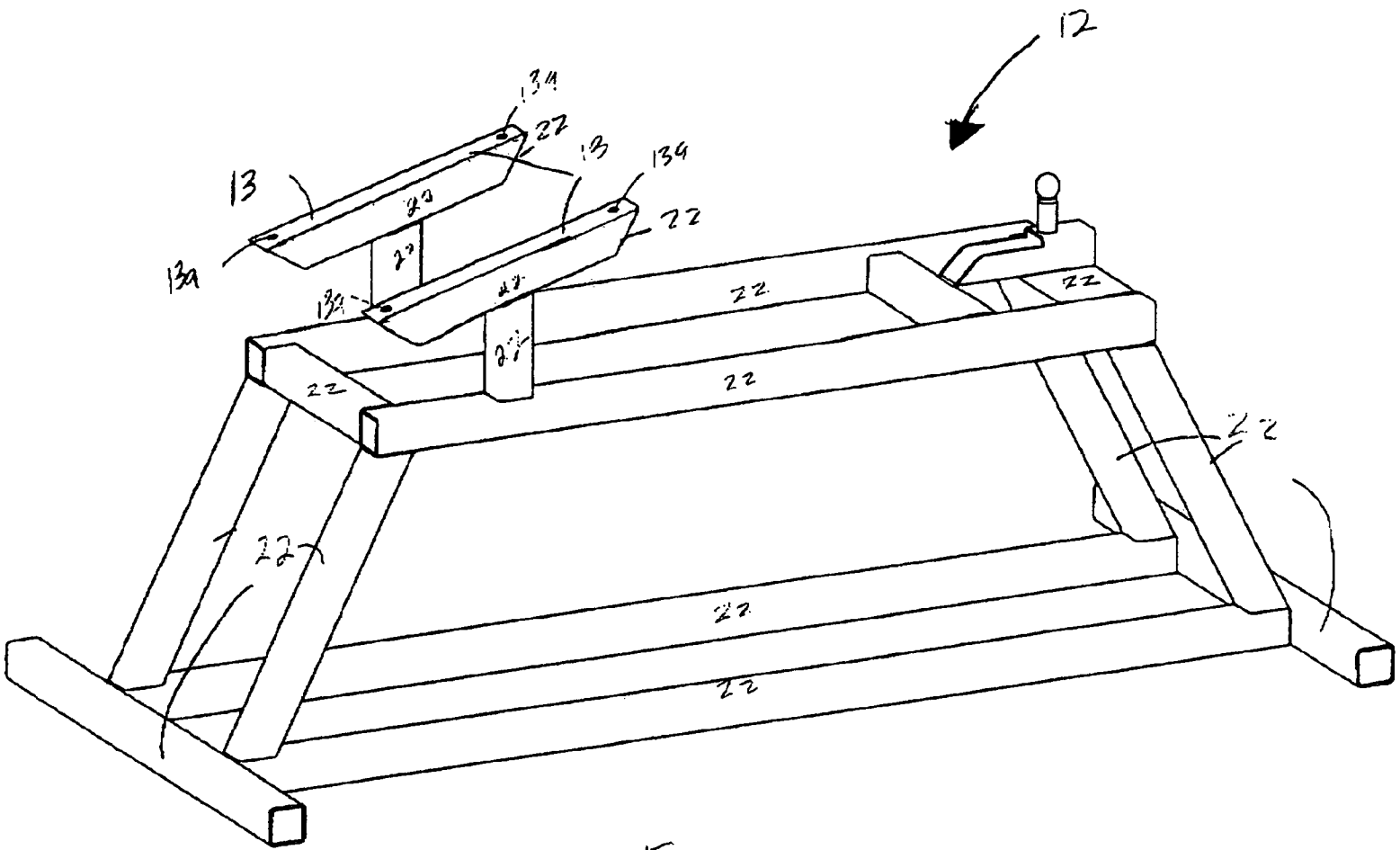
FIG. 4 is an isometric view of a base of the exercise machine of FIGS. 1 and 2, designed and operated according to the Method of the Present Invention.

With particular reference now to FIG. 4, and with continuing reference to FIGS. 1-3, the base 12 may comprise, for example, a variety of materials, geometries, and combinations thereof. For example, the base 12 may include one or more tubular members 22 of unitary or multiple member construction, such as steel square, tubing. For example, the tubular members 22 may be molded, welded, provided in a telescopic arrangement (wherein at least a portion of one tubular member 22 may be inserted into at least a portion of another tubular member 22) or otherwise configured, as in known in the art. The base 12 may be configured with the saddle 14 and/or the lower body support assembly 16 in various ways; including, for example, but not limited to, welded, joined, integral with, or otherwise configured relative to one or more mounting surfaces 13, having mounting means 13*a* to facilitate or accommodate affixation of the saddle 14 to the mounting surfaces 13.

With particular reference now to FIG. 4, and with continuing reference to FIGS. 2 and 3, the saddle 14 may, for example, rest on and be affixed to, the base 12. For example, one or more mounting surfaces 13 of the tubular members 22 of the base 12 may be bolted to (or otherwise attached) to an underside 15 of the saddle 14. The underside 15 may, for example, form mounting means 13*a* therein, to facilitate or accommodate affixation of the saddle 14 to the mount surfaces 13 of the base 12. Mounting means 13*a* may include, for example, a nut and bolt assembly (not shown) and holes 13*a* in the mounting surface for receiving at least a portion of the nut and bolt assembly.

With particular reference now to FIG. 5, and with continuing reference to FIGS. 1-4, the saddle 14 may include, for example, an upper surface 24, having a preselected geometry such as a curvature shown by line 24*a* bisected by an apex A. The upper surface 24 may provide one or more areas of contact for the user 18. The saddle 14 may also include a pad 26 that may comprise one or more materials such as vinyl, leather or suede. The pad 26 may also incorporate a variety of features, for example, predetermined designs or logos; waterproof qualities; and smooth, textured or patterned qualities and features. The saddle 14 and the pad 26 may also incorporate or be associated with padding or other materials (not shown), for example, various layers of soft foam, foam pads, filler material, and/or rebond, alone or in combination.

The lower body support assembly 16 may include, for example, one or more supports such as a leg support 28, or a foot support 30. The lower body support assembly 16 may further include a vertical support member 32; a foot support member 34; and an extension member 36. The lower body support assembly may include, for example, one or more tubular members 22, such as 16*a* and 16*b*, alone or in combination with other component and subcomponents, as hereinafter illustrated.

The leg support 28, for example, may support or restrain one or both legs: or, alternatively, may support one leg while restraining the other (not shown). As illustrated in FIG. 2, the user 18 may position one or both legs 20 over the leg support 28 such that the back of the knee (not shown) comes into physical contact with and rests on the leg support 28. As shown in FIG. 2, the leg support 28 may be used to restrain one or both legs by placement of the one or both legs 20 underneath the leg support 28 such that a portion of a front side of the leg or legs 20 comes into physical contact with the leg support 28. The foot support 30 may support or restrain one or both feet 38. Alternatively. the foot support 30 may support one foot 32 while restraining the other foot 32 (not shown), or the one or both feet 32 may remain free from contact with the foot support 30. As illustrated in FIG. 3, one or both feet 38 may rest on the foot support 30 such that a portion of the sole (not shown) of one or both feet 38 comes into physical contact with the foot support 30. The foot support 30 may also be used as a restraint, whereby one or both feet 38 are placed under the foot support 30 such that an upper surface (not shown) of the foot or feet 38 contacts the foot support 30. In various areas of the Method of the Present Invention, the exercise machine may be used without leg contact with the leg support 28 and/or without foot contact with the foot support 30. The vertical support member 32 may serve to connect or otherwise be associated with the base 12, the leg support bar 28, the leg support member 34, and the extension member 36.

The Method of the Present Invention may provide or facilitate adjustments to various components, thus permitting, for example, personalized fitting of the exercise machine 10, or of various components and subcomponents, to each individual user 20. For example, the vertical support member 32 may include one or more extension sections 32*a*~32*c*, thus permitting selective sizing of the height of the leg support bar 28 and the foot support bar 30 relative to the user 18. Another example may include cooperative elements 34*a*, 34*b* of the foot support member 34, which may co-act to extend or short the foot support bar 30 relative to the user. Yet another example may include cooperative elements 44*a*, 44*b* of the horizontal adjustment member 44, which may be used to adjust the length of the leg support bar 28 and the foot support bar 30 relative to the user 18.

Figure 6:
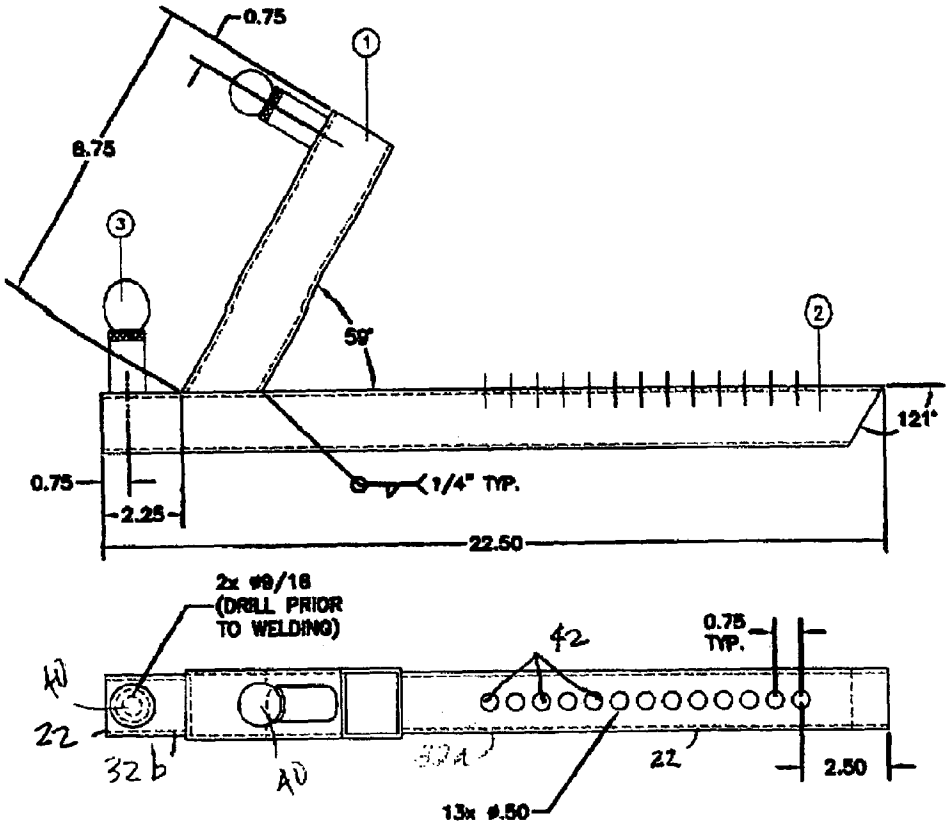
FIG. 6 is a plan view of a portion of a vertical support member of the exercise machine of FIGS. 1 and 2, designed and operated according to the Method of the Present Invention.
Figure 7:
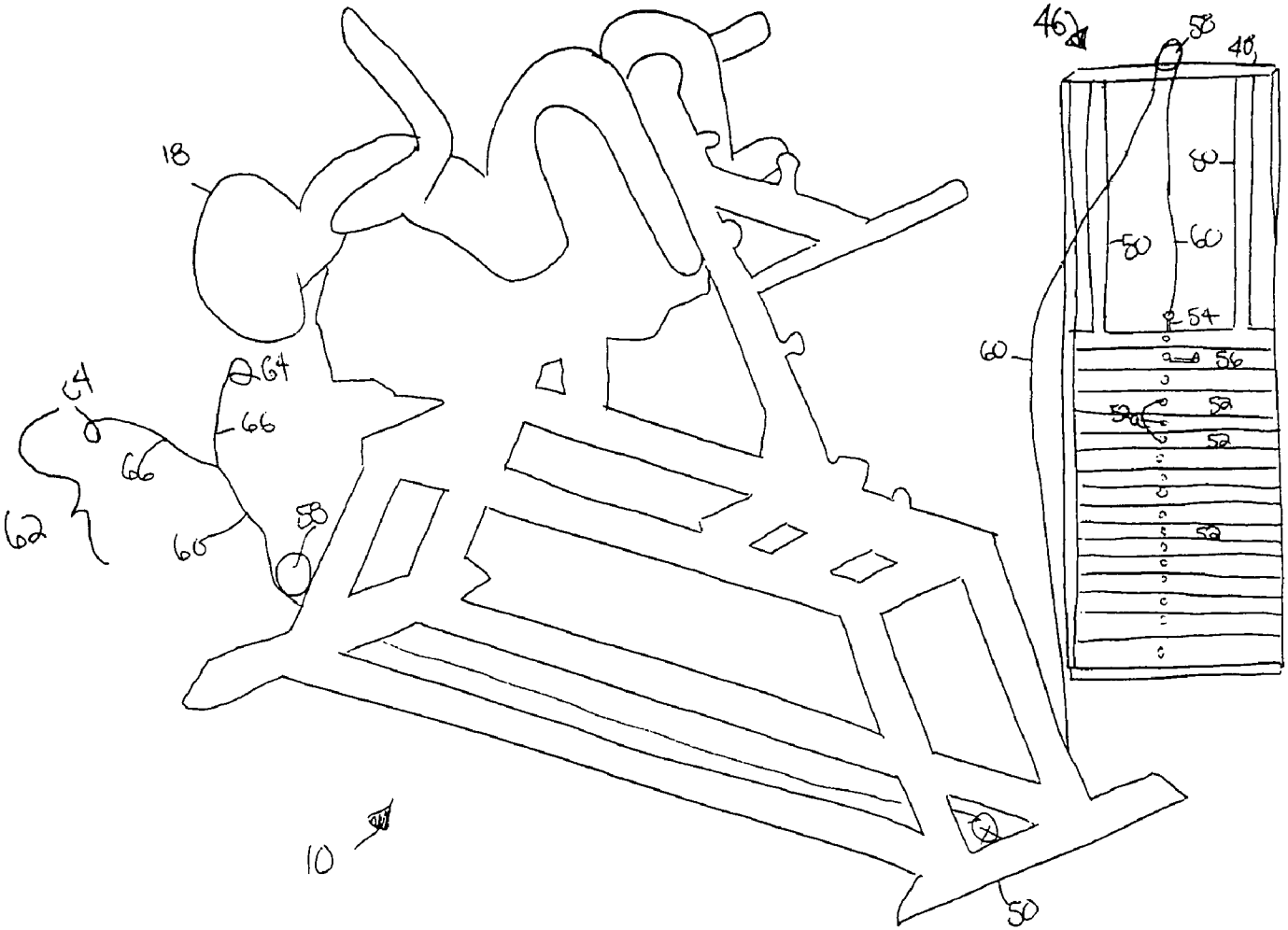
FIG. 7 is a perspective view of an exercise machine and weight assembly, designed and operated according to the Method of the Present Invention.

The Method of the Present Invention contemplates various ways to facilitate adjustment of the exercise machine 10. For example. and with particular reference now to FIG. 6 and continuing reference to FIGS. 1-3, extension sections 32*a* and 32*b* may, for example, cooperatively engage to lengthen or shorten the vertical support member 32. For example, section 32*a* may slidably telescope into section 32*b*. A pop pin mechanism 40 may co-act with a series of holes 42 provided in the sections 32*a* and 32*b* to select and maintain a degree of telescopic length of the vertical support member 32. Extension support member 36 and horizontal adjustment member 44 may be similarly configured. A skilled artisan will recognize that various other components and subcomponents, alone or in combination, may be used to carry out the aforedescribed adjustment functionality.

The exercise machine 10 may facilitate various users for various types of exercises. The exercise machine 10 and/or individual or groups of components or subcomponents may assist in or permit discrete movement positions and/or exercises to, for example, improve or maximize muscle engagement, activation, extension or other parameters.

For example, the curved geometry of the upper surface 14 shown in FIGS. 1-3 and 5 permit hyperextension of the vertebral column or spine; i.e. extension of the spine to an angle greater than 180°. This concept is illustrated by the user 18 wherein points a, e, and b form an angle measuring 180°, as shown along an x-axis. The user 18 supported by the saddle 25 hyperextends the spine (not shown) to an angle represented by points c, e, and d, wherein the angle ced has a measurement greater than 180°, as shown in a first position 26. In this manner t the abdominal muscles may be lengthened to their full extension, while the saddle 14 of the exercise machine 10 may support, for example, the lower lumbar region 18*a* of the user 18. The user 18 may further rest his leg 20 underneath the leg support bar 28 or bend his legs 20 over the leg support bar 28, which may serve to both shorten the length of the hip flexors as well as inhibit their movement. The user 18 may also rest or press one or both feet 38 on the foot support bar 30, which may serve to contract the hamstrings and gluts, thus inhibiting contraction of the hip flexors. In this manner, the user 18 may effectively place the hip flexors into their weakest position, generally rendering them unable to effectively and strongly contract, thus allowing the abs to dominate and maximize contractions during an abdominal-directed exercise.

Furthermore, in the fully extended position, the user 18 may be able to fully contract the hamstring and gluts, further ensuring the inhibition of hip flexor movement during the exercise, thus urging the abs to full recruitment. The user 18 begins to contract the abs (not shown), curving the spine (not shown), bringing the sternum 18*b* towards the pubis 18*c*, and bringing the abdominal region of the body into flexion. The lower lumbar region 18*a* remains supported by the saddle 14, until such as time as the user's weight is no longer exerting a force on the lumbar, thus minimizing exposure to injury to that area. The user 18 may continue the aforedescribed contraction until the abs are fully engaged or flexed. The user may continue the exercise by initiating extension of the fully contracted abs, relaxing the muscles until the body again hyperextends over the saddle 14. In this manner, the abs may be fully and completely initiated and activated over a full range of motion, i.e., from a first position of full extension to a second position of full engagement and returning to the first position. Furthermore, the abs may fully engage without inhibition (without interference from antagonistic muscle groups such as the hip flexors). Additionally, the lower lumbar region 188 of the spine may remain fully supported by the exercise machine 10, thus minimizing the risk of injury to that area.

Alternatively, various exercises may be performed within the maximum range of motion. In addition, various other exercises may be performed. For example, the user 18 may assume the first position 26, with the abs fully extended. The user 18 may then begin to contract the abs, as in the aforedescribed "crunch", except the user 18 may, for example, twist the torso to engage and I or extend various other selected groups of muscles.

The Method of the Present Invention may further provide for adjunct components and assemblies to be used, for example, in conjunction with the exercise machine 10. For example, the exercise machine 10 may be configured with or used in conjunction with a weight assembly 46. The weight assembly may include, for example, a frame 48; guide rod poles 50; a stack (one or more) weights 52; a selection pole 54; a selection key 56; a pulley 58; cable 60; and a harness 62 having a hand grip 64. The frame 48 may be integrally or otherwise associated with the guide rod poles 50. Each weight 52 in the stack of weights 52 may have one or more holes formed therein for slidably receiving the guide rod poles 50. The guide rod poles may then serve to position the weights and provide a path of movement during use. Further, the selection pole 54 may be slidably inserted into the stack of weights 50 via a top hole (not shown) formed in each weight 50 in the stack of weights, such that when the weights are stacked, the top holes therein are generally concentric and form a tubular-shaped recess along a vertical axis (not shown) for receiving the selection pole 54.

The user 18 may select the number of weights to be lifted by partially or completed inserting the selection key into a front hole 52*a* formed in the weight 52, into a pole hole 54 (not shown) generally concentrically aligned along a horizontal axis (not shown), which may delimit the weights 50 to be lifted from the weights remaining below the weight 50 having the selection key 56 inserted therethrough, as is known in the art.

The user 18 may then adopt a position, such as the previously described hyperextended position, with respect to the saddle 14, reaching the arms to grasp the hand grips 64 of the harness 62, pulling shoulder straps 66 over the shoulders (not shown) and grasping the hand grips 64 in front of the user 18—When the user executes, for example, a sit-up or "crunch", the extra weight pulled may exert an extra load on various muscle groups, increasing the beneficial results of the exercise. The weight assembly (or addition of weights) to the exercise machine 10 may be assembled, configured, and used via a variety of means and with a variety of different exercises, and is not limited to the foregoing.

Figure 8:
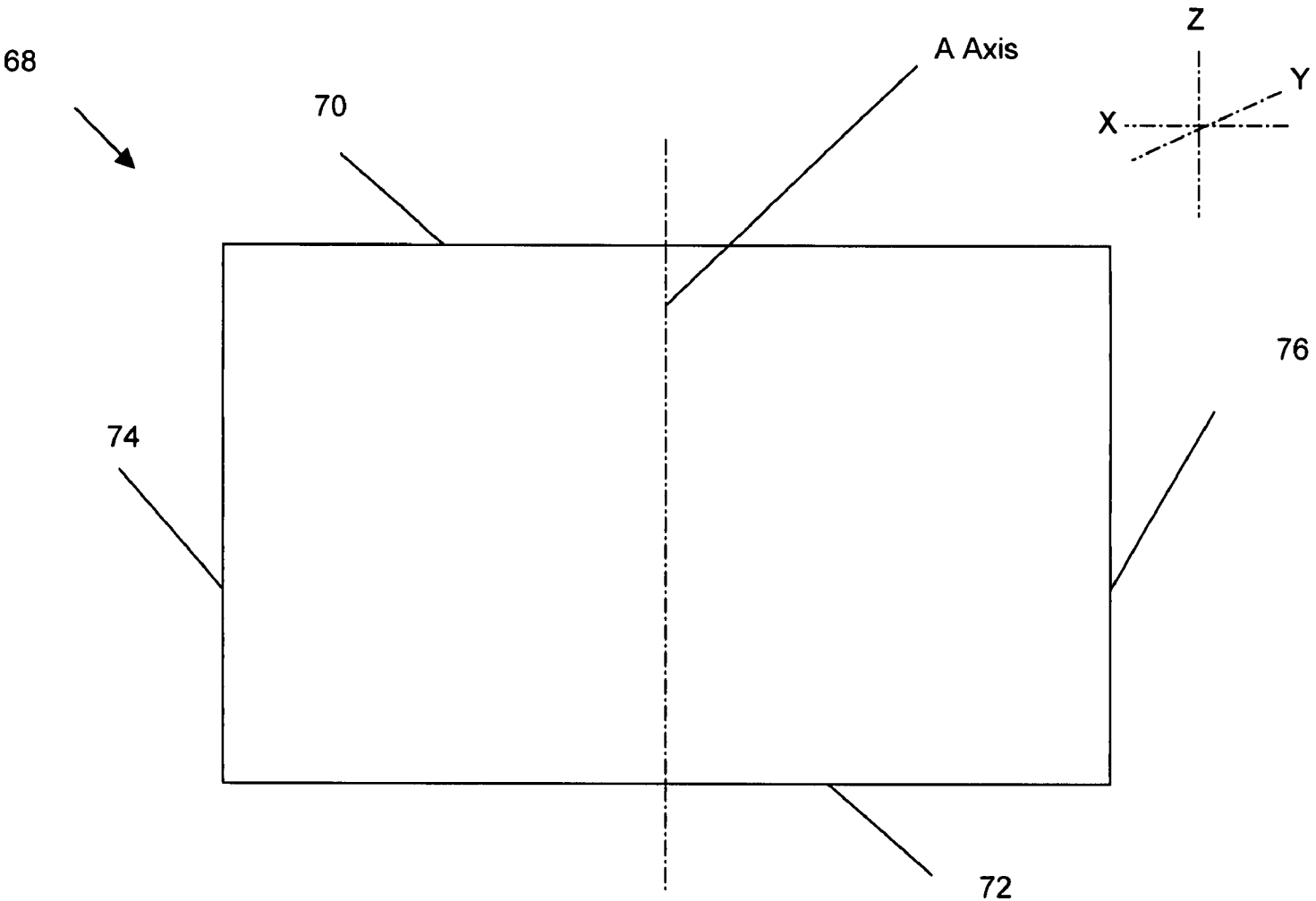
FIG. 8 is a top view of an alternate design of the saddle of FIGS. 1, 2, 3, 4, 5, 6 and 7, designed and operated according to the Method of the Present Invention.
Figure 9:
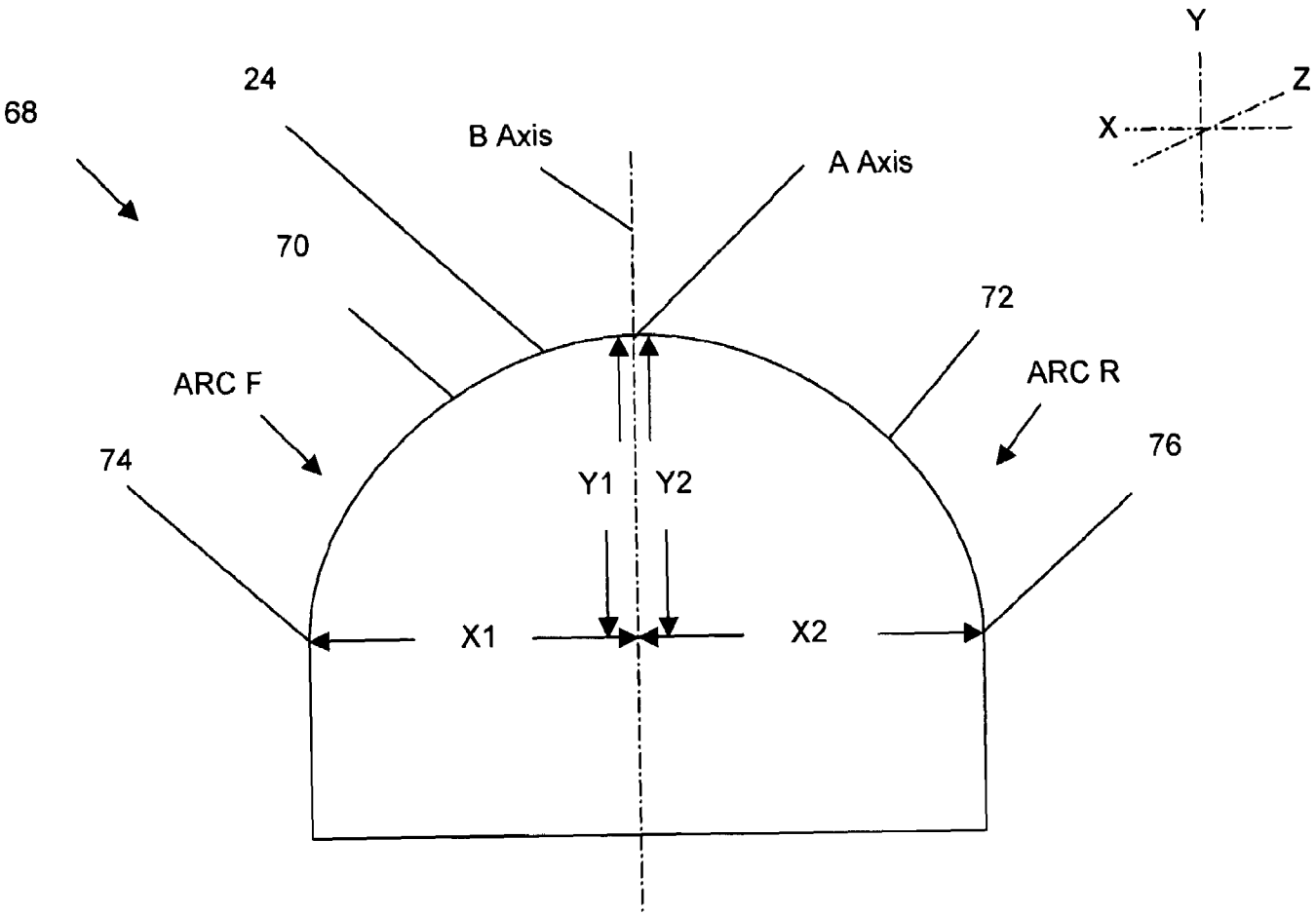
FIG. 9 is a side cut away-view of the alternate saddle design of FIG. 8.

Referring now generally to the Figures and particularly to FIG. 8, FIG. 8 is a top view of an alternate design 68 of the saddle 24 of FIGS. 1, 2, 3, 4, 5, 6 and 7, designed and operated according to the Method of the Present Invention. The top view of FIG. 8 presents the alternate design 68 from the perspective of looking down a vertical Y axis on at the alternate design 68 as it resides in a horizontal plane defined by an X axis and a Z axis. The X, Y and Z axes are all mutually orthogonal.

A first section 70 of the alternate saddle 68 is oriented and designed to support one, more or all of the lumbar vertebrae of the user, and a second section 72 front section 70 of the alternate saddle 68 is oriented and designed to support one, more or all of vertebrae of the user that are not simultaneously supported by the first section. The first section 70 may optionally be configured to support one or more coccyx vertebrae, and/or one or more thoracic or other vertebrae of the user. The second section 72 may also optionally be configured to support one or more thoracic vertebrae, cervical vertebrae or other vertebrae of the user. The first section 70 and the second section 72 are divided by the A axis, wherein the A axis is coincident with the apex A of the surface 24 of the alternate saddle design 68. It is understood that the first section 70 is designed to support the user's vertebrae in an ascending orientation and that the second section 72 is designed to support the user's vertebrae in a descending orientation. The term ascending orientation is defined herein to indicate an orientation of the user's vertebrae wherein at least two vertebrae are positioned relative to the Y axis in an order leading from the lowest coccyx vertebrae toward the highest cervical vertebrae, e.g., as when the user is standing. The term descending orientation is defined herein to indicate an orientation of the user's vertebrae wherein at least two vertebrae are positioned relative to the Y axis in an order leading from the highest cervical vertebrae and toward the lowest coccyx vertebrae, e.g., when the user is doing a head stand.

Referring now generally to the Figures and particularly to FIG. 8, FIG. 8 is a side cut away-view of the alternate saddle design 68 of FIG. 8. A B axis that is parallel with the vertical Y axis, as well as the A axis that is parallel with the Z axis, separates the first section 70 and the second section 72. An arc F of the surface 24 extends from a first edge 74 of the first section 70 to the apex A, and may traverse a distance of from three inches to eighteen inches in a length displacement distance X1 along the X axis, and may also traverse a depth displacement distance Y1 of from three inches to eighteen inches along the vertical Y axis.

An arc R of the surface 24 extends from a second edge 76 of the second section 72 to the apex A, and may traverse a distance of from three inches to eighteen inches in a depth displacement distance X2 along the X axis, and may also traverse a height displacement distance Y2 of from three inches to eighteen inches along the vertical Y axis.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of the illustrated embodiments herein, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

Those skilled in the art will appreciate that various adaptations and modifications of the just-described preferred embodiments can be configured without departing from the scope and spirit of the invention. Other suitable fabrication, manufacturing, assembly, and test techniques and methods known in the art can be applied in numerous specific modalities by one skilled in the art and in light of the description of the present invention described herein. Therefore, it is to be understood that the invention may be practiced other than as specifically described herein. The above description is intended to be illustrative, and not restrictive. Many other embodiments will be apparent to those of skill in the art upon reviewing the above description. The scope of the invention should, therefore, be determined with reference to the knowledge of one skilled in the art and in light of the disclosures presented above.

I claim:

1. An exercise device, the device useful by a human being, the device comprising:

(a) saddle, the saddle comprising a saddle surface having a convex curved surface and a slidable attachment configured for supporting at least a sacrum of a spine of the human being in an ascending orientation, and supporting at least three thoracic vertebrae of the human being in a descending orientation, and the curved surface positioned to partially support a plurality of vertebrae while the human being contracts a plurality of abdominal muscles;

(b) a base, the base affixed to the saddle slidable attachment and the base operable to stabilize the saddle when the saddle is supporting the sacrum during an exercise movement by the human being;

(c) an adjustable knee bar, the knee bar adjustabley coupled with the base and comprising a positionable rest and leverage arm for partially supporting at least one leg of the human being; and (d) an adjustable foot bar, the foot bar adjustabley coupled with the base and the foot bar positionable relative to the knee bar, wherein the body of the human being is fully supported by the convex saddle surface, the knee bar and the foot bar.

2. The device of claim 1, wherein the saddle further comprises a rigid core and a cushion, the cushion interposed between the rigid core and the sacrum.

3. The device of claim 2, wherein the saddle presents a surface having a curvature bisected by an apex positioned to partially support the lumbar and thoracic vertebrae while the human being contracts the abdominal muscles.

4. The device of claim 2, wherein the rigid core is configured to support up at least 200 pounds of applied weight while deforming the saddle surface no more than 1.00 inch away from the applied weight.

5. The device of claim 1, wherein the saddle is further configured to at least partially support at least one lumbar vertebrae in a descending orientation.

6. The device of claim 5, wherein the saddle is further configured to at least partially support five lumbar vertebrae in a descending orientation.

7. The device of claim 1, wherein the saddle is further configured to at least partially support at least one thoracic vertebrae in a descending orientation.

8. The device of claim 5, wherein the saddle is further configured to at least partially support twelve thoracic vertebrae in a descending orientation.

9. An exercise device, the device comprising:

(a) saddle, the saddle presenting a surface having a convex curvature configured for supporting at least a sacrum of a human user spine in an ascending orientation, at least three human user spine thoracic vertebrae in a descending orientation and the applied body mass of a user of at least 200 pounds;

(b) a base, the base coupled with the saddle by a slidable attachment and the base operable to stabilize the saddle when the saddle is supporting the sacrum; and (c) a foot bar, the foot bar coupled with the base and operable to receive force delivered from a human lower leg, wherein the human being drives the foot, ankle or other element of a leg below the knee against the foot bar to stabilize the spine during the performance of an exercise by means of the device.

10. The device of claim 9, the device further compromising a knee bar, the knee bar coupled with the base and operable to receive force delivered from a human leg, wherein the human being drives elements of the leg against both the foot bar and the knee bar and substantively toward the sacrum to stabilize the spine during the performance of an exercise by means of the device.

11. The device of claim 10, wherein the foot bar is configured to receive at least 200 pounds of force without deformation of the saddle surface.

12. The device of claim 1, wherein the device further comprises a free weight, the free weight configured for grasping by the human during the performance of an exercise movement.

13. The device of claim 1, wherein the device further comprises a movable weight coupled with a cable, the cable including a handle configured for pulling by the human while performing an exercise movement.

14. The device of claim 13, wherein the device further comprises a pulley, the pulley configured to receive the cable and support the moveable weight, and the pulley interposed between the weight and cable handle.

15. A method for performing an abdominal exercise by a subject, the method comprising:

(a) providing an exercise device comprising:

i. a saddle, the saddle comprising a saddle surface having a convex curvature and a slidable attachment configured for supporting at least sacrum of the spine of the subject in an ascending orientation, at least three thoracic vertebrae in a descending orientation, the curved surface positioned to partially support a plurality of vertebrae while the subject contracts a plurality of abdominal muscles;

ii. a base, the base affixed to the saddle slidable attachment and the base operable to stabilize the saddle when the saddle is supporting the sacrum during an exercise movement by the subject;

iii. an adjustable knee bar, the knee bar adjustabley coupled with the base and comprising a positionable rest and leverage arm for partially supporting at least one leg of the subject;

iv. an adjustable foot bar, the foot bar adjustabley coupled with the base and the foot bar positionable relative to the knee bar, wherein the body of the subject is fully supported by the convex saddle surface, the knee bar and the foot bar;

(b) the subject assuming a first position of hyperextending a spine over a saddle, the saddle operable to support at least one lumbar vertebrae of the spine;

(c) at least partially inhibiting a hip flexor of the subject; and (d) contraction of the subject of at least one abdominal muscle to draw a sternum of the subject toward a pubis of the subject; and (d) at least one hip flexor of the subject is at least partially inhibited by pressing at least one foot against the foot bar wherein the foot bar is coupled with the saddle.

16. The method of claim 15, wherein the subject grasps and moves a weight during the contraction of the at least one abdominal muscle.

17. The method of claim 15, wherein the subject grasps and pulls a cable during the contraction of the at least one abdominal muscle and the cable is coupled with a moveable weight.

18. The method of claim 17, wherein a pulley is interposed between the weight and the subject, and the pulley is operable to receive and support the weight.

* * * * *